US007012599B2

(12) United States Patent
Sun

(10) Patent No.: US 7,012,599 B2
(45) Date of Patent: Mar. 14, 2006

(54) METHOD FOR REDUCING POWER CONSUMPTION OF AN LCD PANEL IN A STANDBY MODE

(75) Inventor: Wein-Town Sun, Kao-Hsiung (TW)

(73) Assignee: AU Optronics Corp., Hsin-Chu (TW)

( * ) Notice: Subject to any disclaimer, the term of this patent is extended or adjusted under 35 U.S.C. 154(b) by 349 days.

(21) Appl. No.: 10/460,354

(22) Filed: Jun. 13, 2003

(65) Prior Publication Data

US 2004/0130544 A1 Jul. 8, 2004

(30) Foreign Application Priority Data

Jan. 3, 2003 (TW) ..... 92100142 A

(51) Int. Cl.
*G09G 5/00* (2006.01)

(52) U.S. Cl. ..... 345/211; 345/87; 345/96

(58) Field of Classification Search ..... 345/87–88, 345/90–92, 95–96, 99–100, 211, 214
See application file for complete search history.

(56) References Cited

U.S. PATENT DOCUMENTS

| | | | | |
|---|---|---|---|---|
| 6,538,647 | B1 * | 3/2003 | Chen et al. | 345/211 |
| 2002/0149557 | A1 * | 10/2002 | Goetz et al. | 345/100 |
| 2002/0196224 | A1 * | 12/2002 | Ham | 345/94 |
| 2003/0025660 | A1 * | 2/2003 | Miyazawa et al. | 345/87 |

* cited by examiner

*Primary Examiner*—Ricardo Osorio
*Assistant Examiner*—Mansour M. Said
(74) *Attorney, Agent, or Firm*—Winston Hsu

(57) ABSTRACT

A method for reducing power consumption of an LCD panel in a standby mode. The LCD panel includes a plurality of pixel drivers and a plurality of data drivers. Each pixel driver has a liquid crystal capacitor, a storage capacitor, a selection circuit, and four switches. Each data driver has a shift register, a comparator, and several switches. The method includes transmitting data from a signal line to the comparator and comparing the data with a reference voltage, then transmitting a corresponding control signal outputted from the comparator to the selection circuit via the data line, the selection circuit outputting a corresponding display signal to the liquid crystal capacitor according to the control signal.

30 Claims, 8 Drawing Sheets

METHOD FOR REDUCING POWER CONSUMPTION OF AN LCD PANEL IN A STANDBY MODE

BACKGROUND OF INVENTION

1. Field of the Invention

The present invention relates to a liquid crystal display (LCD) panel, and more specifically, to a method of operation of a standby mode of an LCD panel.

2. Description of the Prior Art

An LCD panel operating in a normal mode displays an image with high color, high contrast and high refresh rate, but consumes correspondingly high power.

Generally, the equation used in calculating the consumed power is: $CV^2F+I_SV$; where C is capacitance, V is voltage, F is frequency, and $I_S$ is static current. The values of the capacitance and the voltage usually determine the size and resolution of the LCD panel, and the frequency determines the resolution and performance of a first switch. For reducing power consumption, the LCD panel displays a static image in low gray level via an circuit so that a lower voltage and frequency are transmitted in the data line.

Please refer to FIG. 1 and FIG. 2. FIG. 1 is a schematic diagram of an LCD panel pixel driver 10 with a digital memory 22 according to the prior art. FIG. 1B is a diagram of signals of the pixel driver 10. In FIG. 1, the pixel driver 10 comprises a first switch 12, a storage capacitor 14, and a liquid crystal capacitor 16. The signal of a scan line 20 turns on the first switch 12 so that the signal in the data line 18 is transmitted to the liquid crystal capacitor 16. The storage capacitor 14 and liquid crystal capacitor 16 are connected in parallel for maintaining the voltage of liquid crystal capacitor 16. Additionally the pixel driver 10 comprises a digital memory 22. A first end of the pixel driver 10 is connected to a first end of liquid crystal capacitor 16, and a second end of the pixel driver 10 is connected to the first end of the liquid crystal capacitor 16 through a third switch 24. A second end of the liquid crystal capacitor 16 is connected to a common voltage $V_{COM}$ that is an oscillating voltage. The second switch 24 and the third switch 26 are controlled by a first control line 28 and a second control line 30 respectively.

When the LCD panel operates in a normal mode, the first control line 28 turns off the second switch 24, and the second control line 30 turns off the third switch 26. The data in the data line 18 is transmitted to the liquid crystal capacitor 16 through the first switch 12.

When the LCD panel operates in a standby mode, the data of the liquid crystal capacitor 16 is possibly a high voltage or a low voltage. FIG. 2 is a schematic diagram showing the voltage of the liquid crystal capacitor 16 being a high voltage when the LCD panel operates in a standby mode. In FIG. 2, when the LCD panel operates in a pre-standby mode, the signal of the first control line 28 turns on the second switch 24 to transmit the high voltage stored in the liquid crystal capacitor 16 to the digital memory 22. Then, when the LCD panel operates in standby mode, according to the oscillating cycle of the common voltage $V_{COM}$, the second switch 24 and the third switch 26 are turned on and off in turn to maintain a constant voltage difference is the liquid crystal capacitor 16 so that the LCD panel displays a black display. When the voltage stored in digital memory 22 in the pre-standby mode is a low voltage, according to the oscillating cycle of the common voltage $V_{COM}$, with the second switch 24 and the third switch 26 being turned on and off in turn, the voltage difference in the liquid crystal capacitor 16 is zero so that the LCD panel displays a white image. In addition, storing the voltage of the liquid crystal capacitor 16 in the digital memory 22 can temporarily stop output of the high-frequency voltage in the data line 18 for reducing power consumption.

Please refer to FIG. 3. FIG. 3 is a schematic diagram of an LCD panel pixel driver 32 incorporating a dynamic memory 32 according to the prior art. In FIG. 3, the same elements of FIG. 1 use the same symbols. In addition to the first switch 12, the storage capacitor 14, and the liquid crystal capacitor 16, the pixel driver 32 further comprises a selection switch 34, a complementary selection switch 36, a first connection switch 38, a second connection switch 40, and an address switch 42. When the LCD panel operates in the normal mode, the signal of the scan line 20 turns on the first switch 12 and the address switch 42, and an updating signal line 44, and turns off the first connection switch 38 and the second switch 40, and further, inputs the signal in the data line 18 to the storage capacitor 14. When the voltage stored in the storage capacitor 14 is a high voltage, the selection switch 34 is turned on to transmit the signal of a reference voltage line 46 to the liquid crystal capacitor 16. When the voltage stored in the storage capacitor 14 is a low voltage, the selection switch 34 is turned off and the liquid crystal capacitor 16 maintains a constant voltage. The voltage of the liquid crystal capacitor 16 is controlled by the time that the first switch 12 and the address switch 42 are turned on by the scan line 20.

When the LCD panel operates in the standby mode, the signal of the scan line 20 turns off the first switch 12 and the address switch 42, and the signal of the updating signal line 44 turns on the first connection switch 38 and the second connection switch 40. When the voltage stored in the storage capacitor 14 is a high voltage, the selection switch 34 is turned on and the complementary selection switch 36 is turned off, and the signal in the reference voltage line 46 is transmitted to the liquid crystal capacitor 16 through the first connection switch 38. The LCD panel displays a black image. When the voltage stored in the storage capacitor 14 is a low voltage, the selection switch 34 is turned off and the complementary selection switch 36 is turned on, and the common voltage $V_{COM}$ is transmitted to the liquid crystal capacitor 16 through the second connection switch 40. The LCD panel displays a white image. Therefore, the storage capacitor 14 is identical to the dynamic memory element recording the voltage of the liquid crystal capacitor 16 when the LCD panel operates in a standby mode, and the high-frequency voltage in the data line is not transmitted for reducing power consumption.

When the LCD panel operates in a normal mode, higher voltage and frequency are transmitted in the data line 18 consuming more power. Therefore, after the LCD panel is operated in a standby mode, the transient voltage is recorded by the memory in the pixel driver so that the LCD panel displays a white or black image. However, when the pixel driver 10 in FIG. 1 is combined with the digital memory 22, the amount of transistors and signal lines assembled in the pixel driver 10 is quite large so that the pixel driver 10 is only suitable for a reflective or half-reflective LCD panel. Additionally, the common voltage of the pixel driver 32 in FIG. 3 is a non-oscillating signal that is not suitable for the purposes of reducing physical dimensions and power consumption.

SUMMARY OF INVENTION

It is therefore a primary objective of the claimed invention to provide a method for reducing power consumption of an LCD panel in a standby mode.

According to the claimed invention an LCD panel comprises a plurality of pixel drivers each comprising a liquid crystal capacitor, a storage capacitor, four switches; and a plurality of data drivers each comprising a shift register, a comparator, and a plurality of switches. The method includes the following steps: (a) transmitting data in a signal line to a data line, and turning on a second switch and turning off a forth switch to transmit data from the data line to the liquid crystal capacitor and the storage capacitor; and (b) transmitting the data in the signal line to the comparator, the comparator comparing the signal from the signal line and a reference voltage, outputting a corresponding control signal to a selection circuit of the pixel driver through the data line, and turning on the forth switch and turning off the second switch so that the selection circuit outputs a corresponding display signal to the liquid crystal capacitor according to the control signal.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
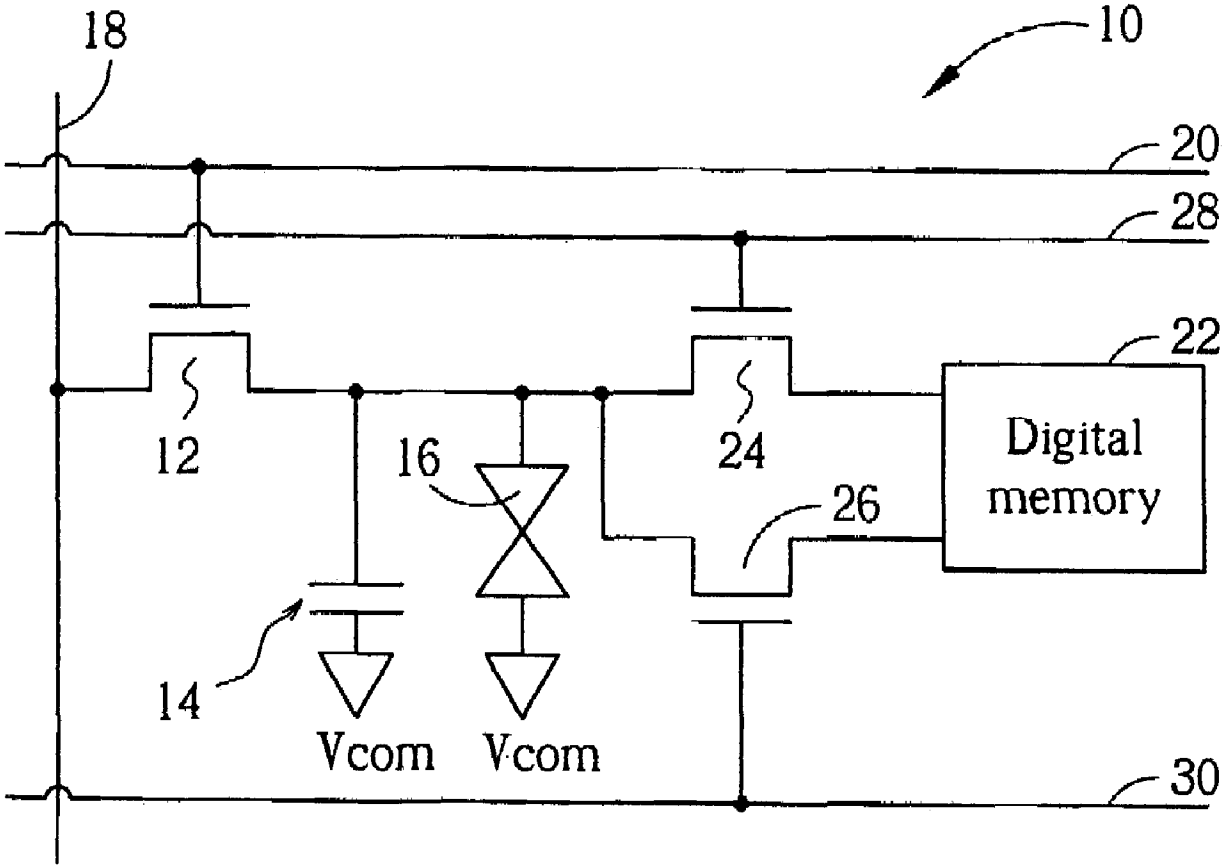
FIG. 1 is a schematic diagram of an LCD panel pixel driver combined with a static according to the prior art.
Figure 2:
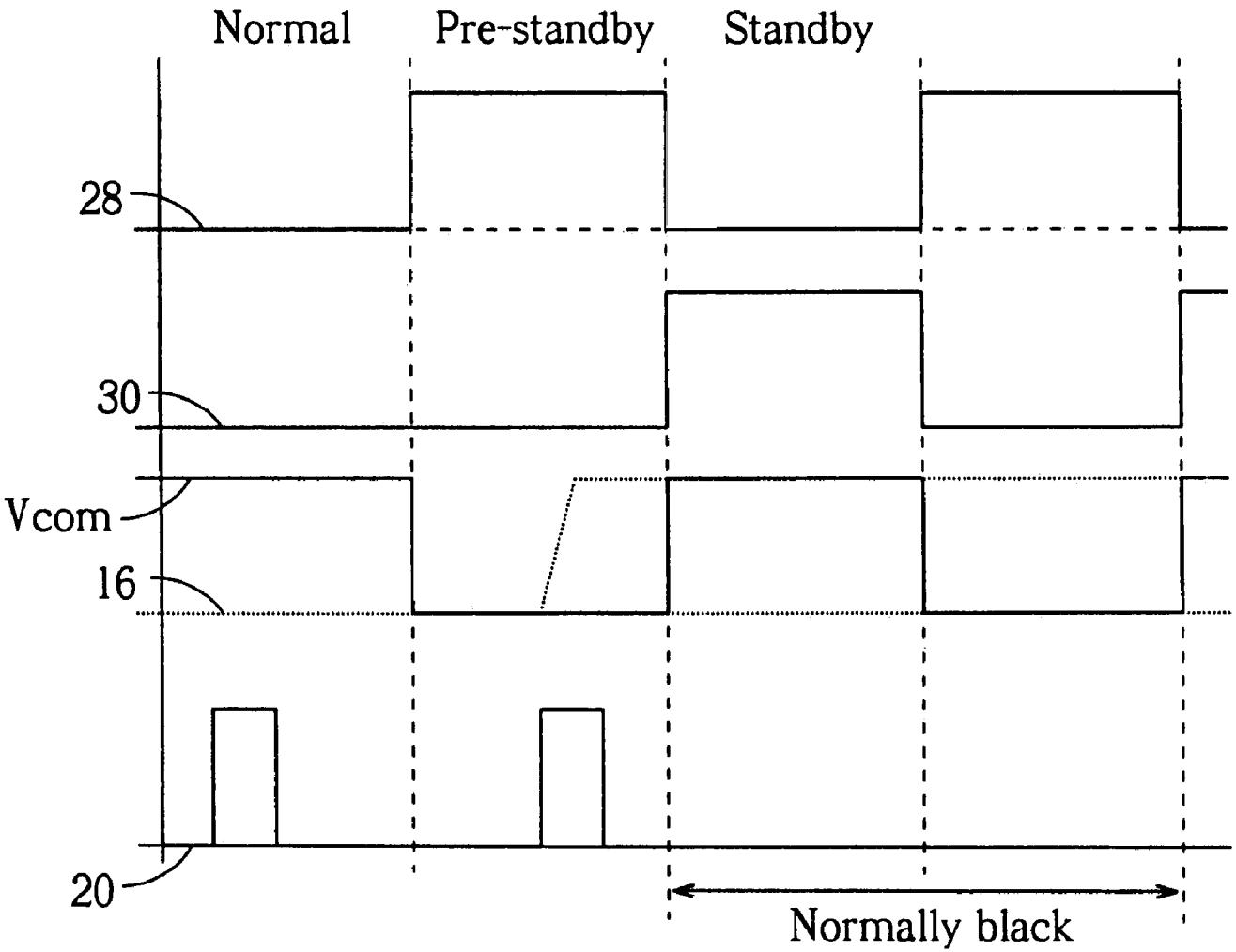
FIG. 2 is a diagram of signals of the pixel driver of FIG. 1.
Figure 3:
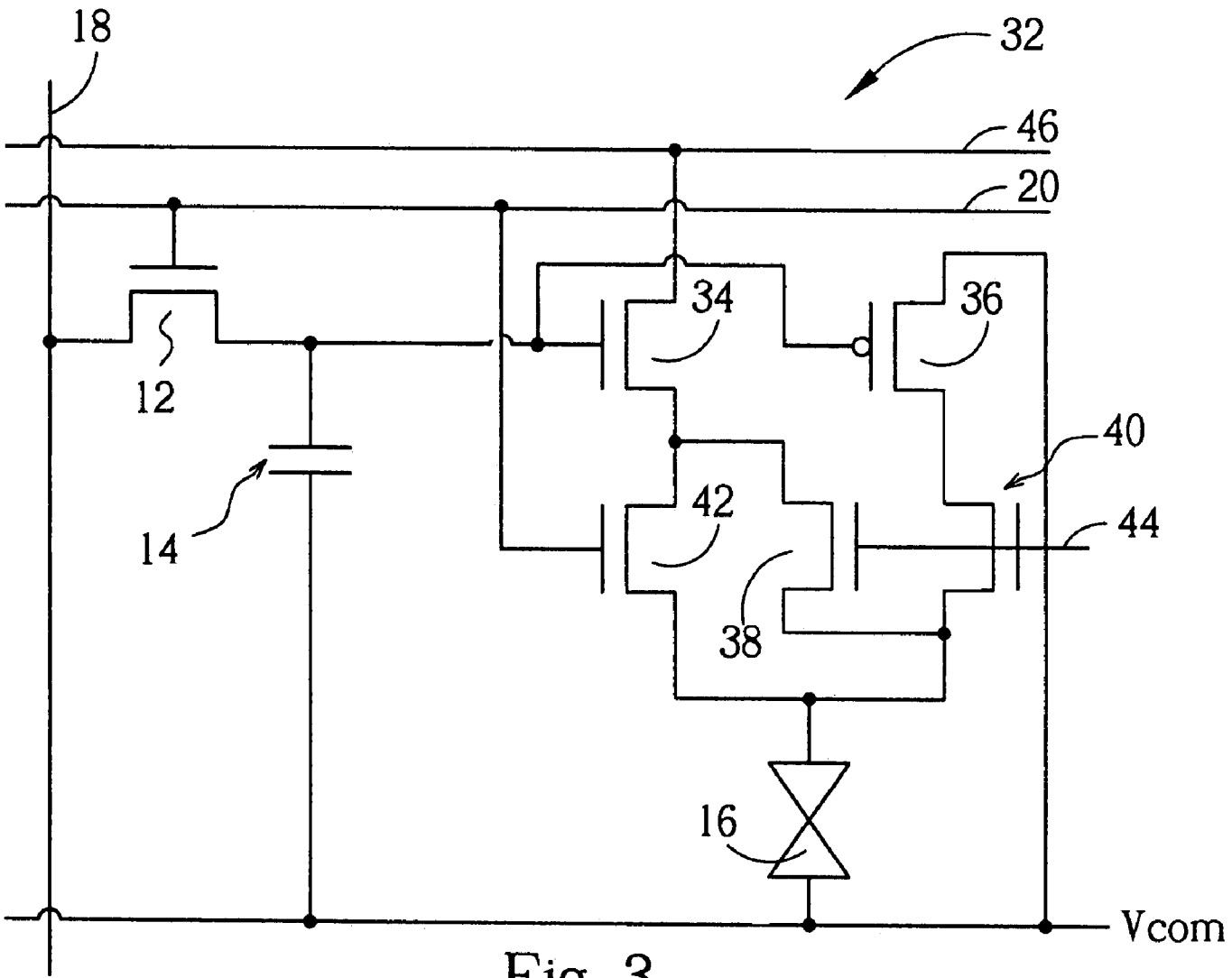
FIG. 3 is a schematic diagram of an LCD panel pixel driver combined with a dynamic memory according to the prior art.
Figure 4:
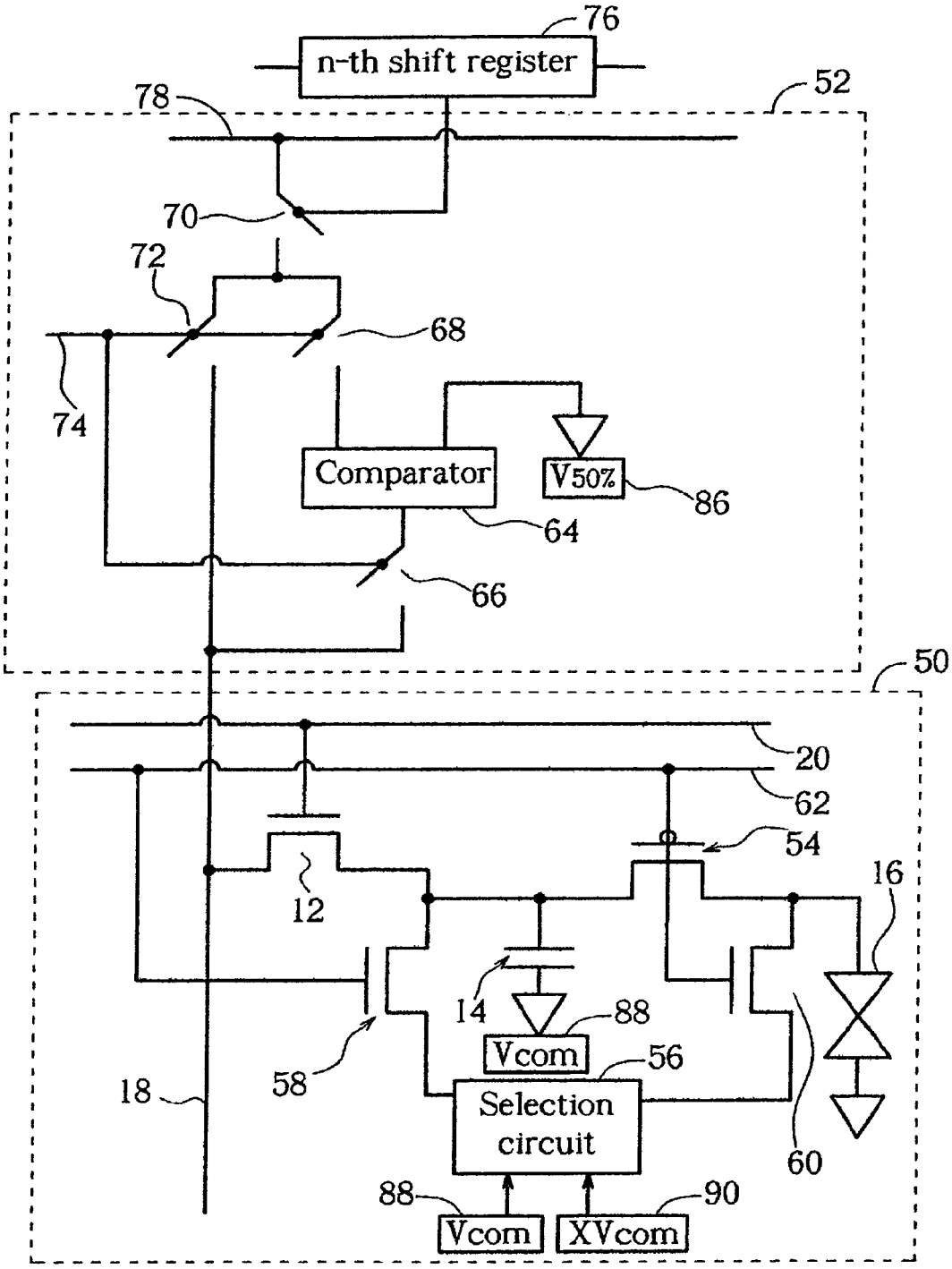
FIG. 4 is a schematic diagram of an LCD pixel driver and a data driver according to the present invention.

Please refer to FIG. 4. FIG. 4 is a schematic diagram of an LCD panel pixel driver 50 and a corresponding data driver 52 according to the present invention. A liquid crystal capacitor 16 is connected between a storage capacitor 14 and a data line 18. The pixel driver 50 also comprises a selection circuit 56, the input end of the selection circuit 56 being connected to the storage capacitor 14 and the output end of the selection circuit 56 being connected to the liquid crystal capacitor 16 through a forth switch 60. The pixel driver 50 also includes a scan line 20 to control a first switch 12 and a second clock 62 to control a second switch 54, a third switch 58, and a forth switch 60. The second switch 54 and the forth switch 60 are complementary switches. When the second switch 54 is turned on, the forth switch 60 is turned off, and when the second switch 54 is turned off, the forth switch 60 is turned on.

Additionally, the ground ends of the storage capacitor 14 and the liquid crystal capacitor 16 are connected to the common voltage $V_{COM}$, and the common voltage $V_{COM}$ can be a constant level signal or an oscillating signal. In this embodiment, the oscillating signal is used as the common voltage $V_{COM}$ for illustration.

The data driver 52 of the present invention includes a comparator 64. The output end of the comparator 64 is connected to the data line through a seventh switch 66, and the input end of the comparator 64 is connected to a fifth switch 70 through an eighth switch 68. The data line 18 is connected to the fifth switch 70 through a sixth switch 72. The data driver 52 also includes a first clock 74 to control the sixth switch 72, the seventh switch 66, and the eighth switch 68. The sixth switch 72 and the eighth switch 68 are complementary switches, and the seventh switch 66 and the eighth switch 68 are turned on and off simultaneously. The LCD panel of the present invention also includes a shift register 76 to control the fifth switch 70, which is connected to a video line 78. When the fifth switch 70 is turned on, the data in the video line 78 is transmitted to the data line 18 or the comparator 64 according to the signal of the first clock 74. Additionally, the comparator 64 and the selection circuit 56 in FIG. 4 can have any kind of circuit structures provided that they perform as described. Also, the number of transistors used in the selection circuit 56 should be decreased when the pixel driver 50 is used in a transmission LCD panel application.

When the LCD panel operates in a normal mode, the seventh switch 66, and the eighth switch 68 of the data driver 52 are turned off; the sixth switch 72, the first switch 12 and the second switch 54 of the pixel driver 50 are turned on; and the third switch 58 and the forth switch 60 of the pixel driver 50 are turned off. When the fifth switch 70 is turned on, the data of the video line 78 is transmitted to the data line 18 through the sixth switch 72, and the data line 18 charges the storage capacitor 14 and the liquid crystal capacitor 16 through the first switch 12. Before the LCD panel operates in a power-saving mode, the LCD panel first operates in a pre-standby mode. The first switch 12, the third switch 58, and the forth switch 60 of the data driver 50 are turned on, and the second switch 54 is turned off. When the fifth switch 70 is turned on, the data of the video line 78 is transmitted to the comparator 64 through the eighth switch 68. The comparator 64 compares the data of the video line 78 and a reference voltage $V_{50\%}$ 86 to output a control signal to data line 18 through the seventh switch 66, and then the control signal is transmitted to the selection circuit 56 and storage capacitor 14 through the first switch 12 and the third switch 58. The selection circuit 56 outputs a corresponding display signal to the liquid crystal capacitor 16 through the forth switch 60 according to the control signal. The reference voltage $V_{50\%}$ 86 is a 50% transmission pixel voltage. When the voltage of the video line 78 is higher than the reference voltage $V_{50\%}$ 86, the selection circuit 56 outputs an inverted common voltage $XV_{COM}$ 90 to maintain a high voltage between the liquid crystal capacitor 16 according to the control signal to control the LCD panel to display a black image. The inverted common voltage $XV_{COM}$ 90 and the common voltage $V_{COM}$ 88 are complementary signals. In other words, when the voltage of the video line 78 is lower than the common voltage $V_{50\%}$ 86, the selection circuit 56 outputs the common voltage $V_{COM}$ 88 to maintain a low voltage in the liquid crystal capacitor 16 to control the LCD panel to display a white image. And then, the LCD panel operates in a standby mode. The voltage $XV_{COM}$ or $V_{COM}$ determined by the selection circuit 56 is transmitted to the liquid crystal capacitor 16 until the data driver 52 and the scan driver are turned on and the second clock CK2 is lower than a low-voltage, so that the LCD panel operates in a normal mode.

Figure 5:
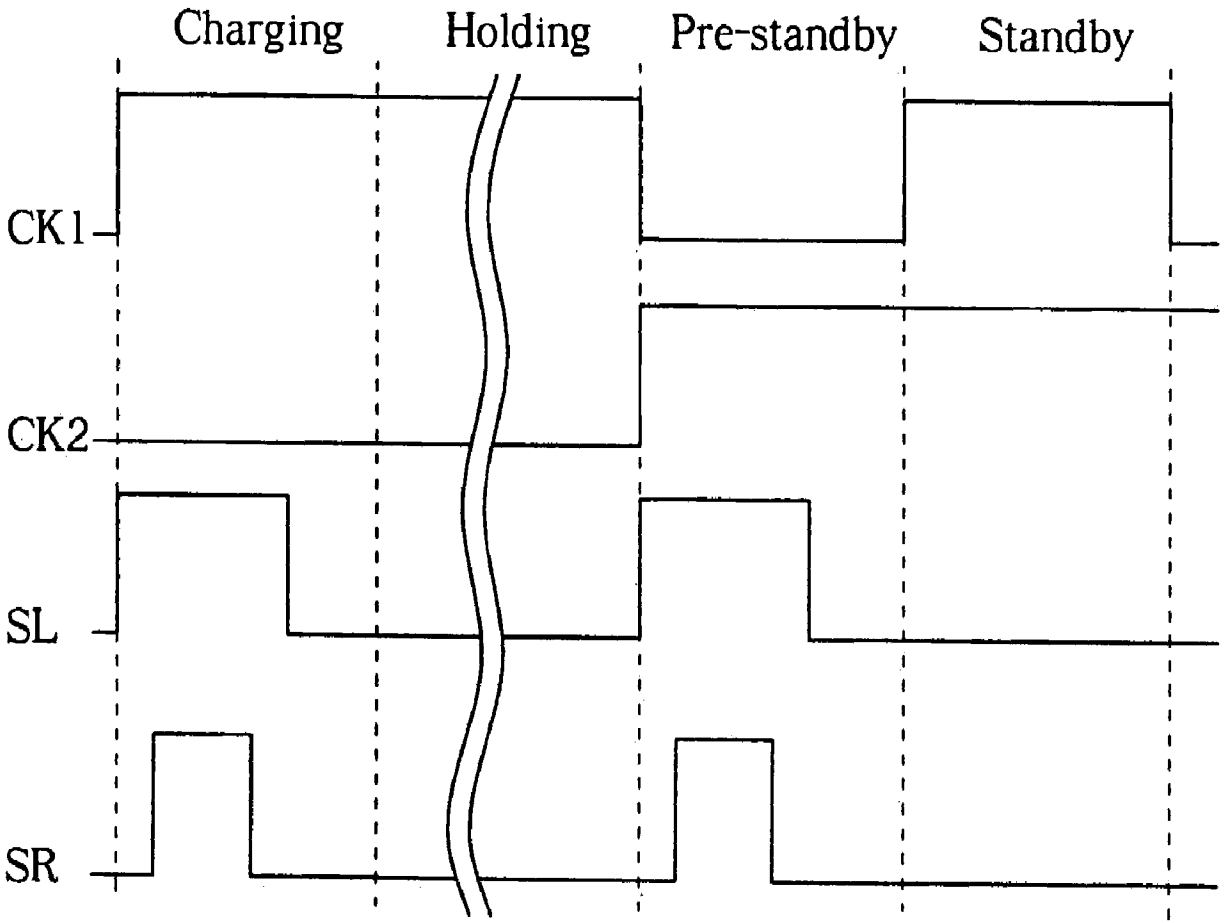
FIG. 5 is a diagram of signals in the pixel driver of FIG. 4.

Please refer to FIG. 5. FIG. 5 is a diagram of signals of the pixel driver 50 and the data driver 52. As shown in FIG. 5, CK1 is the signal of the first clock 74, CK2 is the signal of the second clock 62, SL is the signal of the scan line 20, and SR is the signal of the shift register 76. When the LCD panel operates in a normal mode, there are two steps performed, namely a charging stage and a holding stage. In the charging stage, the first clock 74 turns on the sixth switch 72, and turns off the seventh switch 66 and the eighth switch 68; the second clock 62 turns on the second switch 54, and turns off the third switch 58 and the forth switch 60; the scan line turns on the first switch 12; and the shift register 76 turns on the fifth switch 70 for a period to transmit the data of the video line 78 to the storage capacitor 14 and the liquid crystal capacitor 16 through the data line 18. In the holding stage, the first clock 74 and the second clock 62 hold the same state, the scan line 20 turns off the first switch 12, and the storage capacitor 14 maintains the voltage of the liquid crystal capacitor 16.

There are two stages when the LCD panel operates in a power-saving mode, the pre-standby stage and the standby stage. In the pre-standby stage, the first clock 74 turns off the sixth switch 72, and turns on the seventh switch 66 and the eighth switch 68; the second clock 62 turns off the second switch 54, and turns on the third switch 58 and the forth switch 60 when Vcom is required at the low voltage. When the scan line 20 turns on the first switch 12, the shift register 76 turns on the fifth switch 70 for a period to transmit the data of the video line 78 to the comparator 64, and the comparator 64 compares the data of the video line 78 and the reference voltage $V_{50\%}$ 86 and outputs the control signal to the selection circuit 56 and storage capacitor 14 according to the comparison result. And, the first clock 74 turns on the sixth switch 72 and turns off the seventh switch 66 and the eighth switch 68 to identify the result that the comparator 64 outputs. The state of the second clock 62 is held the same. When the voltage of the video line 78 is higher than the reference voltage $V_{50\%}$ 86, the control signal is a high voltage and the selection circuit outputs the inverted common voltage $XV_{COM}$ 90 to the liquid crystal capacitor 16. When the voltage of video line 78 is lower than the reference voltage $V_{50\%}$ 86, the control signal is a low voltage and the selection circuit 56 outputs a common voltage $V_{COM}$ 88 to the liquid crystal capacitor 16. At this time, the data driver 52, shift register 76 and the scan driver could be turned off. In the standby stage, the voltage $XV_{COM}$ or $V_{COM}$ determined by the selection circuit 56 is transmitted to the liquid crystal capacitor 16 until the data driver 52 and scan driver are turned on. The scan driver restarts scanning and the second clock signal CK2 is lowered to a low voltage, and the LCD operates in the normal mode.

Figure 6:
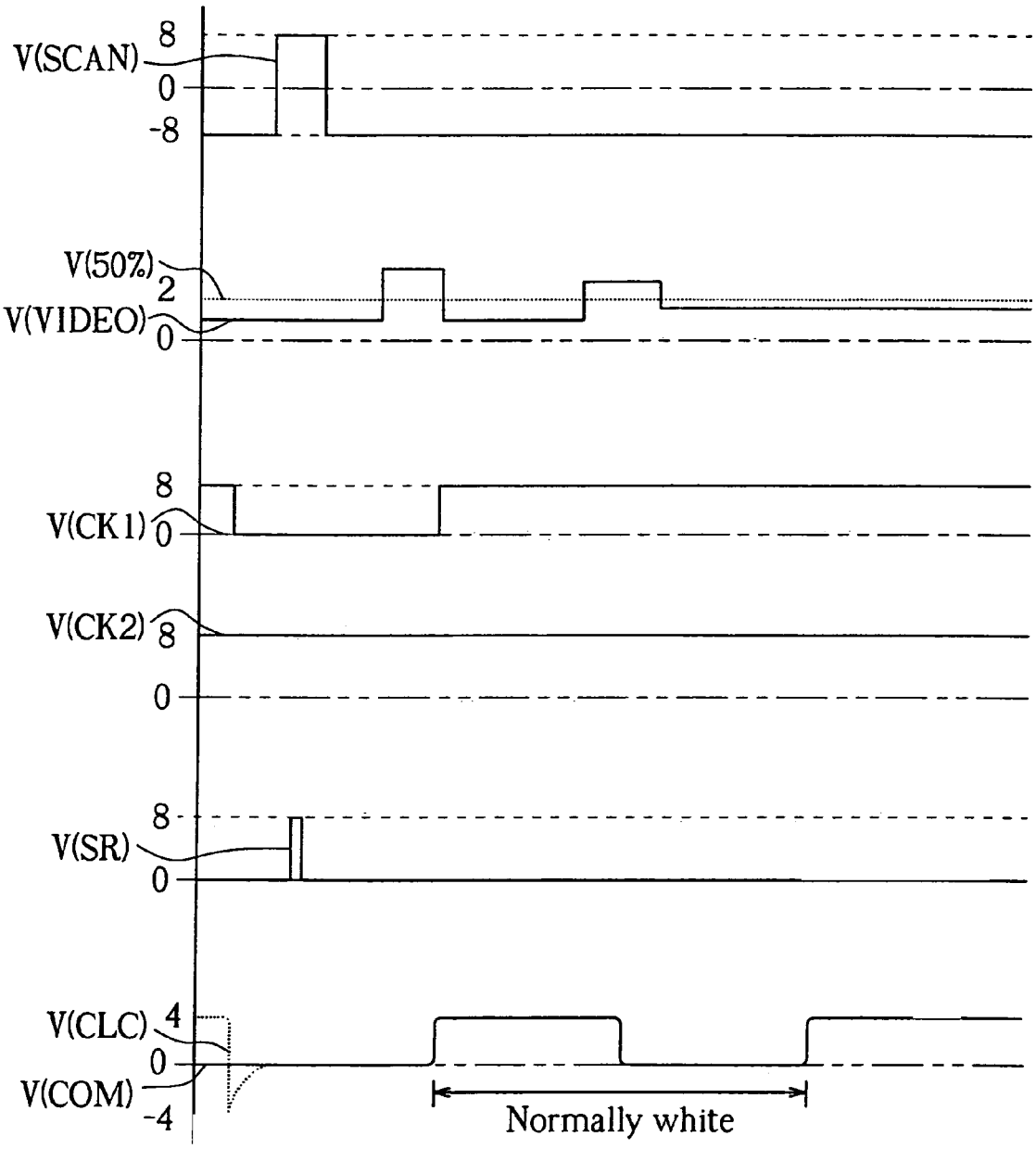
FIG. 6 and FIG. 7 are diagrams of voltages of the pixel driver and the data driver of FIG. 4.
Figure 7:
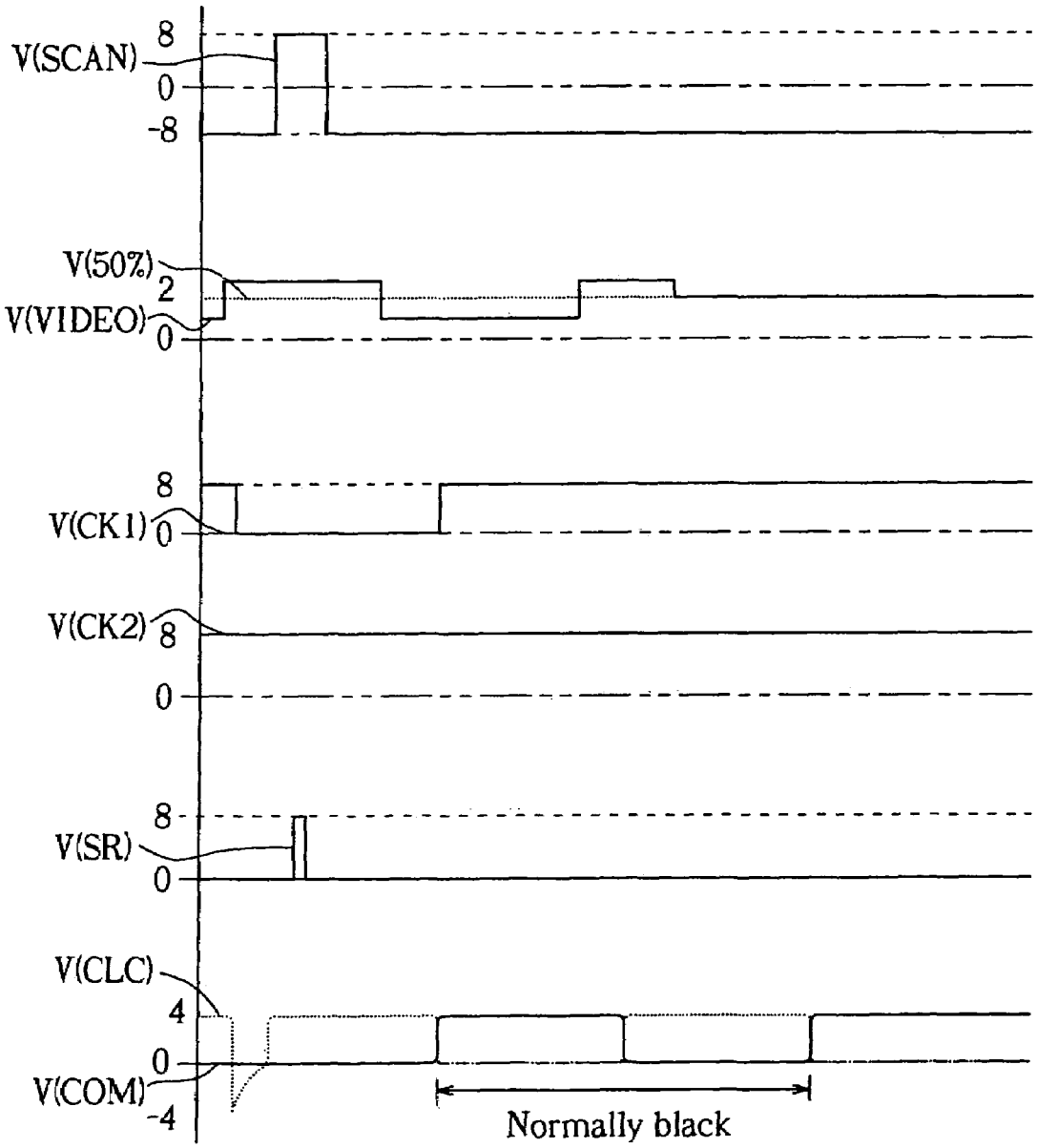

Please refer to FIG. 6 and FIG. 7. FIG. 6 and FIG. 7 are diagrams of voltages of the pixel driver 50 and the data driver 52 in FIG. 4 during operation. V(SCAN) is the voltage of the scan line 20, V(VIDEO) is the voltage of the video line 78, V(50%) is the reference voltage $V_{50\%}$ 86, V(CK1)is the voltage of the first clock 74, V(CK2) is the voltage of the second clock 62, V(COM) is the voltage of common voltage $V_{COM}$ 88, and V(CLC) is the voltage of the liquid crystal capacitor 16. When the LCD panel operates in the power-saving mode, the LCD panel first enters into the pre-standby stage. The low voltage of the first clock 74 turns off the sixth switch 72, and turns on the seventh switch 66 and the eighth switch 68; the high voltage of the second clock 62 turns off the second switch 54, and turns on the third switch 58 and the forth switch 60. When the voltage of the scan line 20 is raised to a high voltage to turn on the first switch 12, the shift register 76 is raised to a high voltage to turn on the fifth switch 70 and transmit the voltage of the video line 78 to the comparator 64. The comparator 64 compares the voltage of the video line 78 and the reference voltage $V_{50\%}$ 86, outputs the control signal to the data line 18, and transmits the control signal to the selection circuit 56 through the first switch 12 and the third switch 58. The shift register 76 and the scan line 20 are lowered to a low voltage in turn to turn off the fifth switch 70 and the first switch 12. When the selection circuit 56 receives the control signal that the comparator 64 has outputted, the voltage of the first clock 74 is raised to a high voltage turning on the sixth switch 72, and turning off the seventh switch 66 and the eighth switch 68. And then, the LCD panel operates in the standby mode. Referring to V(CLC) and V(COM) shown in the FIG. 6, when the voltage of the video line 78 is lower than the voltage $V_{50\%}$ 86, the selection circuit 56 outputs the common voltage $V_{COM}$ 88 to the liquid crystal capacitor 16, the voltage difference in the liquid crystal capacitor 16 is zero, and the LCD panel displays a white image. Referring to V(CLC) and V(COM) shown in FIG. 7, when the voltage of video line 78 is higher than the reference voltage $V_{50\%}$ 86, the selection circuit 56 outputs the inverted common voltage $XV_{COM}$ 90 to the liquid crystal capacitor 16, the voltage difference between the liquid crystal capacitor 16 is 4V, and the LCD panel displays a black image.

Figure 8:
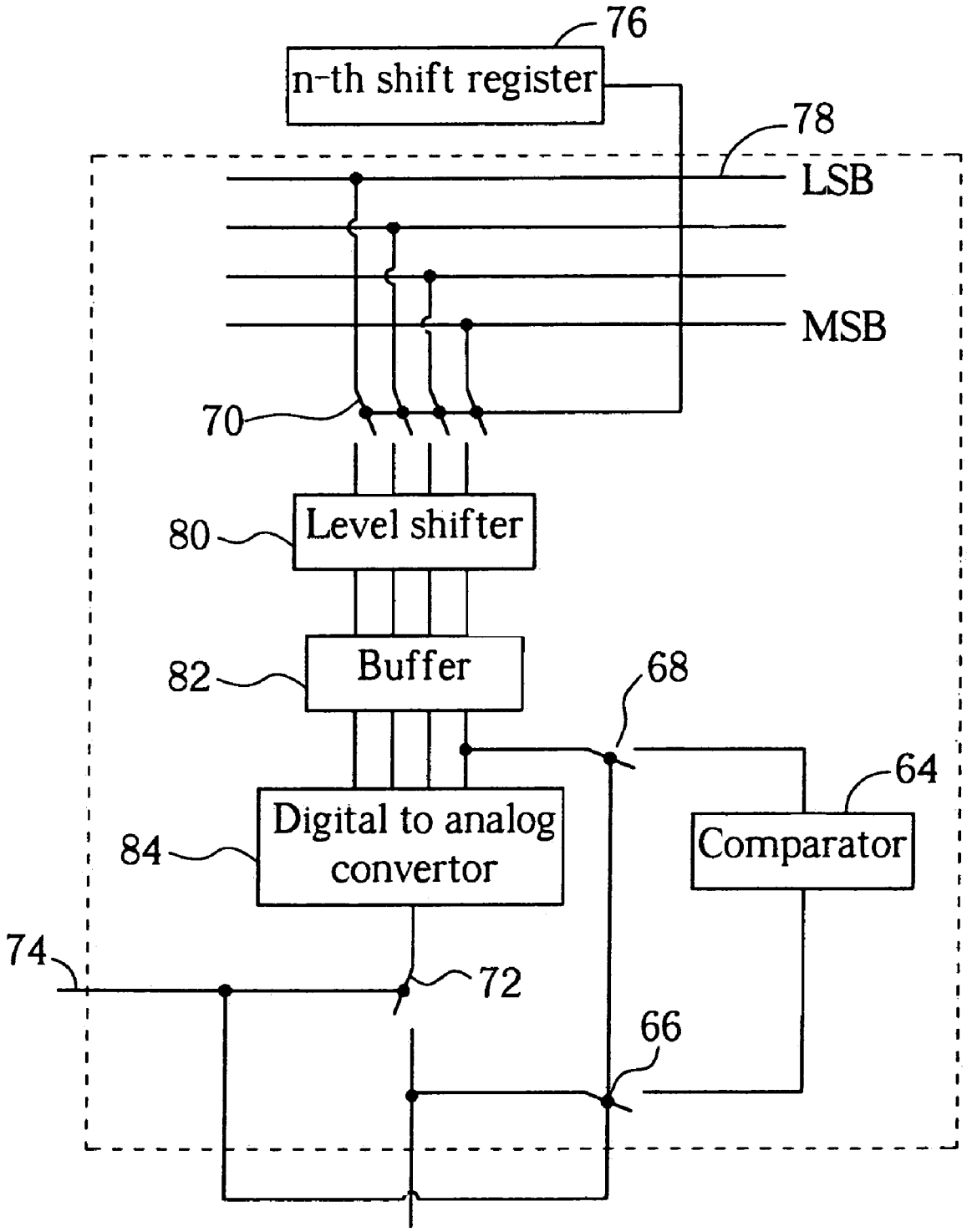
FIG. 8 is a schematic diagram of a second embodiment of a data driver according to the present invention.

Please refer to FIG. 8. FIG. 8 is a schematic diagram of a data driver according to a second embodiment of the present invention. When the data in the data line is digital, a level shifter 80, a buffer 82, and a digital-to-analog converter (DAC) 84 are disposed between the fifth switch 70 and the sixth switch 72. Before being transmitted to the data line 18, the digital data is regulated by the level shifter 80, and the data is stored in buffer 82. When the LCD panel operates in the normal mode, the first clock 74 turns on the sixth switch 72 and turns off the seventh switch 66 and the eighth switch 68, and the data stored in buffer 82 is transmitted to the DAC 84 and transformed into a signal capable of charging the storage capacitor 14 and the liquid crystal capacitor 16 through the first switch 12. When the LCD panel operates in the standby mode, the first clock 74 turns off the sixth switch 72 and turns on the seventh switch 66 and the eighth switch 68. The MSB stored in the buffer 82 is transmitted to the comparator 64 as a digital signal through the eighth switch 68, and the comparator 64 compares the MSB and the reference voltage $V_{50\%}$ 86 and outputs the control signal to the data line 18 through the seventh switch 66. The other operation process is the same as the process described referencing FIG. 4 and is not repeated.

From the above description, a pixel driver is combined with the second switch 54, the third switch 58, the forth switch 60, and the selection circuit 56. In addition, the data driver 52 is combined with the comparator 64. For turning on and off the second switch 54, the third switch 58, and the forth switch 60, the pixel driver 50 of the present invention operates in a normal mode the same way the prior art pixel driver does. When the LCD panel operates in the pre-standby mode, the comparator 64 in the data driver 52 compares the voltage of the video line 78 and the reference voltage $V_{50\%}$ 86, and outputs the control signal to the selection circuit 56 according to the comparison result. The selection circuit 56 then outputs the corresponding voltage to the liquid crystal capacitor 16 according to the control signal and controls the voltage of the liquid crystal capacitor 16, being a high voltage or a low voltage, to control the LCD panel to display a white or black image. This further stops transmitting the high-frequency signal of the video line 78, and turns off the data driver and the scan driver for reduced power consumption.

Compared with the prior art, the pixel driver 50 of the invention operating in the normal mode transmits the data in the video line 78 to the data line 18, and charges the storage capacitor 14 and the liquid crystal capacitor 16 directly through the first switch 12. Structurally, the pixel driver of the present invention is much the same as the conventional pixel driver. In addition, the conventional pixel driver 32 combined with the dynamic memory in the prior art uses a pulse width of time that the first switch 12 turns on to control the voltage of the storage capacitor 14. The charge time of the liquid crystal capacitor 16 is determined by the voltage of the storage capacitor 14. And, the liquid crystal capacitor 16 is not directly charged by the data line 18 so that there are may be some problems in operation. Additionally, an inverted or non-inverted common voltage $V_{COM}$ is suitable for the pixel driver 50 in the present invention. When the common voltage $V_{COM}$ is inverted, the peak voltage is smaller and the power consumption is reduced. The common voltage $V_{COM}$ of the pixel driver 32 combined with the dynamic memory in the prior art is non-inverted, and is thus not suitable for power-saving and size reduction. Additionally, when the pixel driver 50 of the present invention operates in the standby mode, the number of transistor used in the selection circuit 56 for reducing power consumption is less than the number used in the pixel driver 32 combined with the dynamic memory in the prior art. When the comparator 64 is assembled in the driver circuit 52, the number of transistor used in the pixel driver 50 in the invention can be decreased so that the pixel driver 50 is not only suitable for a reflective LCD panel or a half-reflective LCD panel, but it is also suitable for a transmission LCD panel.

Those skilled in the art will readily observe that numerous modifications and alterations of the device may be made while retaining the teachings of the invention. Accordingly, the above disclosure should be constructed as limited only by the metes and bounds of the appended claims.

What is claimed is:

1. A method for reducing power consumption of an LCD panel in a standby mode, the LCD panel comprising a plurality of pixel drivers, a plurality of data drivers, and a shift register, each pixel driver comprising:

a liquid crystal capacitor;

a storage capacitor connected to a data line and connected to the liquid crystal capacitor through a second switch; and a selection circuit having an input end connected to the data line and an output end connected to the liquid crystal capacitor through a fourth switch;

each data driver comprising:

a comparator for comparing data from a video line with a reference voltage and outputting a corresponding control signal;

a fifth switch connected to the video line;

a sixth switch connected between the fifth switch and the data line; and a seventh switch connected between the comparator and the data line;

the method comprising:

(a) the shift register turning on the fifth switch and a first clock turning on the sixth switch and turning off the seventh switch to transmit data from the video line to the data line, turning on the second switch and turning off the fourth switch to transmit the data from the data line to the liquid crystal capacitor and the storage capacitor; and (b) the shift register turning on the fifth switch and the first clock turning off the sixth switch and turning on the seventh switch to transmit data from the video line to the comparator and using the comparator to compare the data with the reference voltage, then transmitting a corresponding control signal outputted from the comparator to the selection circuit through the data line, and turning on the fourth switch and turning off the second switch so that the selection circuit outputs a corresponding display signal to the liquid crystal capacitor according to the control signal.

2. The method of claim 1 wherein the data driver further comprises a level shifter connected to the fifth switch for adjusting a level of the data from the video line, a buffer connected to the level shifter for storing the data being output from the level shifter, and a digital to analog converter (DAC) connected between the buffer and the sixth switch for converting the digital data stored in the buffer to an analog signal, an input end of the comparator connected to an output end of the buffer.

3. The method of claim 1 wherein the pixel driver further comprises a first switch connected between the data line and the storage capacitor, the first switch being turned on by a scan line in step (a) and step (b); and a third switch connected between the storage capacitor and the selection circuit, the third switch turning on and off at the same time as the fourth switch.

4. The method of claim 1 wherein in the step (b), when the voltage of the storage capacitor is higher than the reference voltage, the selection circuit outputs a black display signal to the liquid crystal capacitor; and when the voltage of the storage capacitor is lower than the reference voltage, the selection circuit outputs a white display signal to the liquid crystal capacitor.

5. The method of claim 1 wherein the reference voltage is a pixel voltage of approximately 50% light transmission.

6. The method of claim 1 wherein the storage capacitor and the liquid crystal capacitor are connected to a common voltage.

7. The method of claim 6 wherein the common voltage is an oscillating signal or a constant level signal.

8. A method for reducing power consumption of an LCD panel in a standby mode, the LCD panel comprising a plurality of pixel drivers and a plurality of data drivers, each pixel driver comprising:

a liquid crystal capacitor;

a storage capacitor connected to a data line and connected to the liquid crystal capacitor through a second switch;

a selection circuit having an input end connected to the data line and an output end connected to the liquid crystal capacitor through a fourth switch;

a first switch connected between the data line and the storage capacitor; and a third switch connected between the storage capacitor and the selection circuit;

each data driver comprising:

a comparator for comparing data from a video line with a reference voltage and outputting a corresponding control signal;

the method comprising:

(a) turning on the first switch with a scan line, transmitting data of the video line to the data line, turning on the second switch and turning off the third switch and the fourth switch to transmit the data from the data line to the liquid crystal capacitor and the storage capacitor; and (b) turning on the first switch with a scan line, transmitting data from the video line to the comparator and using the comparator to compare the data with the reference voltage, then transmitting a corresponding control signal outputted from the comparator to the selection circuit through the data line, and turning on the third switch and the fourth switch and turning off the second switch so that the selection circuit outputs a corresponding display signal to the liquid crystal capacitor according to the control signal.

9. The method of claim 8 wherein the LCD panel further comprises a shift register, and the method further comprises using the shift register to control a fifth switch to transmit the data from the video line to the data line or to the comparator.

10. The method of claim 9 wherein the data driver further comprises a sixth switch connected between the filth switch and the data line, and a seventh switch connected between the comparator and the data line; the method further comprising in step (a), the shift register turns on the fifth switch and a first clock turns on the sixth switch and turns off the seventh switch to transmit the data from the video line to the data line, and in step (b), the shift register turns on the fifth switch and the first clock turns off the sixth switch and turns on the seventh switch to output the control signal from the comparator to the data line.

11. The method of claim 10 wherein the data driver further comprises a level shifter connected to the fifth switch for adjusting a level of the data from the video line, a buffer connected to the level shifter for storing the data being output from the level shifter, and a digital to analog converter (DAC) connected between the buffer and the sixth switch for converting the digital data stored in the buffer to an analog signal, an input end of the comparator connected to an output end of the buffer.

12. The method of claim 8 wherein in the step (b), when the voltage of the storage capacitor is higher than the reference voltage, the selection circuit outputs a black display signal to the liquid crystal capacitor; and when the voltage of the storage capacitor is lower than the reference voltage, the selection circuit outputs a white display signal to the liquid crystal capacitor.

13. The method of claim 8 wherein the reference voltage is a pixel voltage of approximately 50% light transmission.

14. The method of claim 8 wherein the storage capacitor and the liquid crystal capacitor are connected to a common voltage.

15. The method of claim 14 wherein the common voltage is an oscillating signal or a constant level signal.

16. A method for reducing power consumption of an LCD panel in a standby mode, the LCD panel comprising a plurality of pixel drivers and a plurality of data drivers, each pixel driver comprising:

a liquid crystal capacitor;

a storage capacitor connected to a data line and connected to the liquid crystal capacitor through a second switch; and a selection circuit having an input end connected to the data line and an output end connected to the liquid crystal capacitor through a fourth switch;

each data driver comprising:

a comparator for comparing data from a video line with a reference voltage and outputting a corresponding control signal;

the method comprising:

(a) transmitting data of the video line to the data line, turning on the second switch and turning off the fourth switch to transmit the data from the data line to the liquid crystal capacitor and the storage capacitor; and (b) transmitting data from the video line to the comparator and using the comparator to compare the data with the reference voltage, then transmitting a corresponding control signal outputted from the comparator to the selection circuit through the data line, and turning on the fourth switch and turning off the second switch so that the selection circuit outputs a corresponding display signal to the liquid crystal capacitor according to the control signal; wherein when the voltage of the storage capacitor is higher than the reference voltage, the selection circuit outputs a black display signal to the liquid crystal capacitor, and when the voltage of the storage capacitor is lower than the reference voltage, the selection circuit outputs a white display signal to the liquid crystal capacitor.

17. The method of claim 16 wherein the LCD panel further comprises a shift register, and the method further comprises using the shift register to control a fifth switch to transmit the data from the video line to the data line or to the comparator.

18. The method of claim 17 wherein the data driver further comprises a sixth switch connected between the fifth switch and the data line, and a seventh switch connected between the comparator and the data line; the method further comprising in step (a), the shift register turns on the fifth switch and a first clock turns on the sixth switch and turns off the seventh switch to transmit the data from the video line to the data line, and in step (b), the shift register turns on the fifth switch and the first clock turns off the sixth switch and turns on the seventh switch to output the control signal from the comparator to the data line.

19. The method of claim 18 wherein the data driver further comprises a level shifter connected to the fifth switch for adjusting a level of the data from the video line, a buffer connected to the level shifter for storing the data being output from the level shifter, and a digital to analog converter (DAC) connected between the buffer and the sixth switch for converting the digital data stored in the buffer to an analog signal, an input end of the comparator connected to an output end of the buffer.

20. The method of claim 18 wherein the pixel driver further comprises a first switch connected between the data line and the storage capacitor, the first switch being turned on by a scan line in step (a) and step (b); and a third switch connected between the storage capacitor and the selection circuit, the third switch turning on and off at the same time as the fourth switch.

21. The method of claim 18 wherein the reference voltage is a pixel voltage of approximately 50% light transmission.

22. The method of claim 18 wherein the storage capacitor and the liquid crystal capacitor are connected to a common voltage.

23. The method of claim 22 wherein the common voltage is an oscillating signal or a constant level signal.

24. An LCD panel comprising:

a plurality of pixel drivers, each pixel driver comprising:

a liquid crystal capacitor;

a second switch controlled by a second clock;

a fourth switch controlled by the second clock complementary to the switching of the second switch;

a storage capacitor having a first end connected to a data line and connected to the liquid crystal capacitor through the second switch; and a selection circuit having an input end connected to the data line and an output end connected to the liquid crystal capacitor through the fourth switch;

a plurality of data drivers, each data driver comprising:

a comparator for comparing data from a video line with a connected reference voltage;

a fifth switch connected between the video line and a node, the fifth switch controlled by a shift register;

a sixth switch connected between the node and the data line, the sixth switch controlled by a first clock; and a seventh switch connected between an output end of the comparator and the data line, the seventh switch controlled by the first clock complementary to the switching of the sixth switch.

25. The LCD panel of claim 24 wherein each data driver further comprises an eighth switch connected between the node and an input end of the comparator, the eighth switch controlled by the first clock simultaneous with the switching of the seventh switch.

26. The LCD panel of claim 24 wherein each pixel driver further comprises a first switch connected between the data line and the first end of the storage capacitor and controlled by a scan line, and a third switch connected between the first end of the storage capacitor and the input end of the selection circuit and controlled by the scan line.

27. The LCD panel of claim 24 wherein each data driver further comprises a level shifter connected to the fifth switch for adjusting a level of data from the video line, a buffer connected to the level shifter for storing data output from the level shifter, and a digital to analog converter (DAC) connected between the buffer and the sixth switch for converting digital data stored in the buffer to an analog signal, an input end of the comparator connected to an output end of the buffer.

28. The LCD panel of claim 24 wherein the reference voltage is a pixel voltage of approximately 50% light transmission.

29. The LCD panel of claim 24 wherein the storage capacitor and the liquid crystal capacitor are connected to a common voltage.

30. The LCD panel of claim 29 wherein the common voltage is an oscillating signal or a constant level signal.

* * * * *